US008668220B2

(12) United States Patent
Hay

(10) Patent No.: US 8,668,220 B2
(45) Date of Patent: Mar. 11, 2014

(54) WHEELCHAIR SYSTEM

(71) Applicant: Carl M. Hay, Portland, OR (US)

(72) Inventor: Carl M. Hay, Portland, OR (US)

( * ) Notice: Subject to any disclaimer, the term of this patent is extended or adjusted under 35 U.S.C. 154(b) by 0 days.

(21) Appl. No.: 13/858,858

(22) Filed: Apr. 8, 2013

(65) Prior Publication Data

US 2013/0228998 A1 Sep. 5, 2013

Related U.S. Application Data

(63) Continuation of application No. 13/179,481, filed on Jul. 9, 2011, now Pat. No. 8,414,008.

(51) Int. Cl.
*A61G 5/10* (2006.01)

(52) U.S. Cl.
USPC ..... 280/304.1; 280/250.1; 280/296

(58) Field of Classification Search
USPC ..... 280/304.1, 250.1, 296
See application file for complete search history.

(56) References Cited

U.S. PATENT DOCUMENTS 6,131,679 A * 10/2000 Pulver et al. ..... 180/65.1
6,607,250 B2 * 8/2003 Papac ..... 301/111.06
6,923,278 B2 * 8/2005 Mulhern et al. ..... 180/65.1
7,264,272 B2 * 9/2007 Mulhern et al. ..... 280/755
7,438,145 B2 * 10/2008 Shin ..... 180/65.1
7,445,291 B2 * 11/2008 Parkel et al. ..... 297/423.1
7,735,847 B2 * 6/2010 Dougherty ..... 280/304.1
8,152,192 B2 * 4/2012 Dougherty ..... 280/304.1
2006/0000664 A1 * 1/2006 Huang et al. ..... 180/907
2007/0096427 A1 * 5/2007 Knaub ..... 280/304.1

* cited by examiner

*Primary Examiner* — Kevin Hurley
*Assistant Examiner* — Michael Stabley
(74) *Attorney, Agent, or Firm* — Michael J. Andri

(57) ABSTRACT

A wheelchair system and an accessory system for a wheelchair are disclosed. According to one embodiment, the accessory system may include an accessory frame having one or more interface elements to mount to a wheelchair frame. The accessory system may include a wheel assembly rotatably coupled to the accessory frame by a first fastener. The accessory system may include an engagement system further coupling the accessory frame to the wheel assembly. The engagement system may include a channel guide member defining a channel having a notched region. The channel guide member may be rotatably coupled to one of the accessory frame or wheel assembly by a second fastener. The engagement system may further include a translating member retained within the channel of the channel guide member. The translating member may be fixed to another one of the accessory frame or wheel assembly.

19 Claims, 5 Drawing Sheets

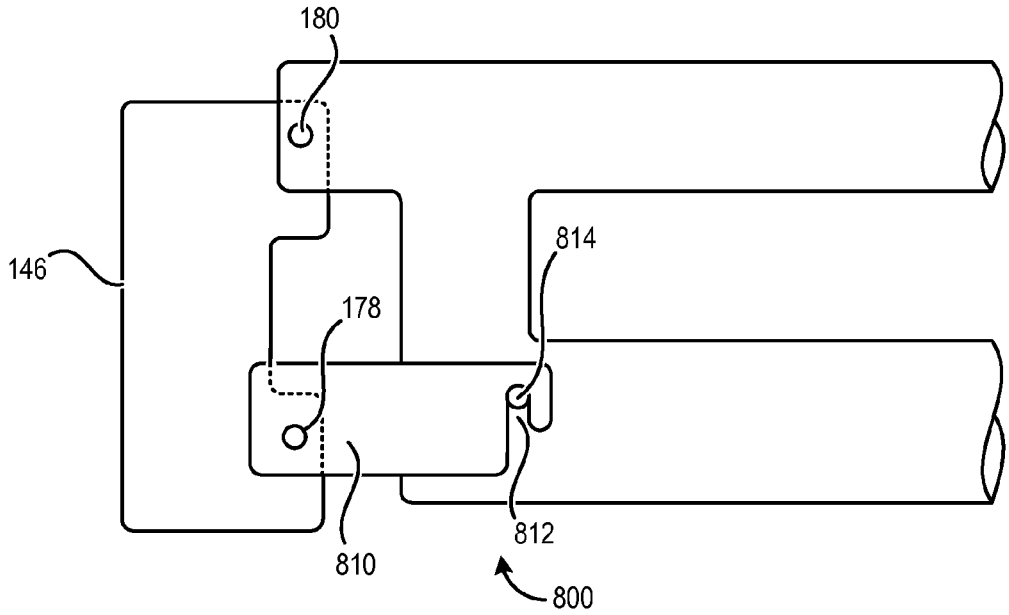
FIG. 8
FIG. 9
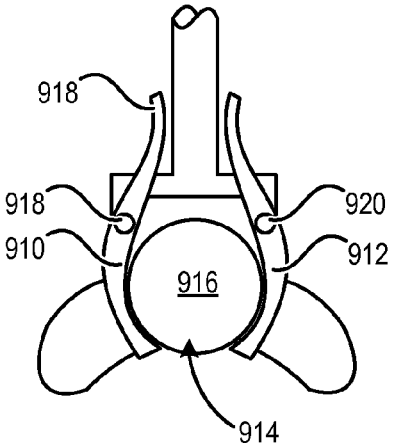
FIG. 10
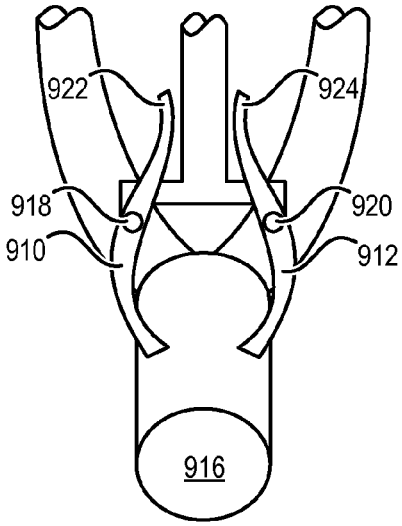

WHEELCHAIR SYSTEM

CROSS-REFERENCE TO RELATED APPLICATIONS

The present application is a non-provisional of and claims priority to U.S. Non-Provisional patent application Ser. No. 13/179,481, titled WHEELCHAIR SYSTEM, filed Jul. 9, 2011, the entire contents of each of which are incorporated herein by reference in their entirety for all purposes.

BACKGROUND

Wheelchairs that are suitable for indoor use may be unsuitable for certain outdoor uses. For example, wheelchairs typically used indoors often include smaller front wheels located substantially under the front portion of the frame that enable the wheelchair to be turned within a confined space. These smaller wheels and/or limited wheelbase may make mobility difficult on uneven or soft surfaces typically encountered in outdoor environments. Accessories have been proposed for improving outdoor use of wheelchairs. One accessory, for example, enables a user to add a larger diameter front wheel to the wheelchair that also increases the length of the wheelbase. The larger diameter front wheel and/or increased wheelbase may improve mobility of the wheelchair on uneven or soft surfaces as compared to the smaller wheels and/or shorter wheelbase of the wheelchair.

SUMMARY

A wheelchair system and an accessory system for a wheelchair are disclosed. According to one embodiment, the accessory system may include an accessory frame having one or more interface elements to mount to a wheelchair frame. The accessory system may include a wheel assembly rotatably coupled to the accessory frame by a first fastener. The accessory system may include an engagement system further coupling the accessory frame to the wheel assembly. The engagement system may include a capture member defining a capturing region. The capture member may be rotatably coupled to one of the accessory frame or the wheel assembly by a second fastener. The engagement system may include a captured element fixed to another one of the accessory frame or the wheel assembly. The capture element may be adapted to fit within or be accepted by the capturing region of the capture member.

If the captured element is located within the capturing region of the capture member, the engagement system may provide a load bearing connection between the wheel assembly and the accessory frame (i.e., the engaged state). If the captured element is located outside the capturing region of the capture member, the engagement system may provide a non-load bearing connection between the wheel assembly and the accessory frame (i.e., the disengaged state).

The load bearing connection provided by the engagement system may be selected, for example, to at least partially support the wheelchair by one or more wheels of the wheel assembly with the original front wheels of the wheelchair raised relative to the ground. By contrast, the non-load bearing connection may be selected to lower the original front wheels of the wheelchair to the ground so that the wheelchair is at least partially supported by the original front wheels. The engagement system disclosed herein may enable a rotational axis of a fork portion of the wheel assembly to be angled relative to a vertical axis if the engagement system is set to the disengaged state, and may enable the rotational axis to be rotated up to the vertical axis or other suitable angle if the engagement system is set to the engaged state. Stability of the wheelchair system may be improved by utilizing a vertical or substantially vertical rotational axis as compared to a non-vertical rotational axis.

Claimed subject matter, however, is not limited by this summary as other embodiments or examples may be disclosed by the written description and associated drawings.

BRIEF DESCRIPTION OF DRAWINGS

FIG. 8 is a schematic diagram depicting another example engagement system according to one embodiment.

FIG. 9 is a schematic diagram depicting yet another example engagement system in an engaged state according to one embodiment.

FIG. 10 is a schematic diagram depicting the engagement system of FIG. 9 in a disengaged state according to one embodiment.

DETAILED DESCRIPTION

Figure 1:
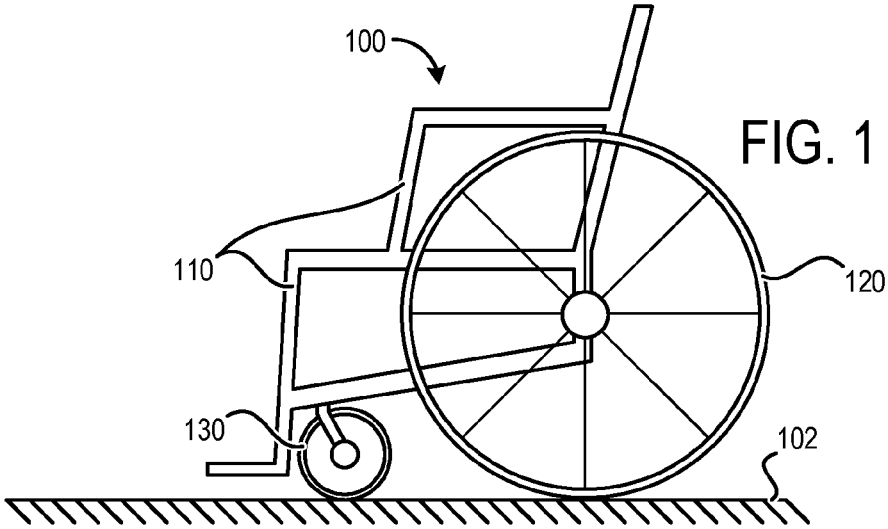
FIG. 1 is a schematic diagram depicting an example wheelchair without the disclosed accessory system according to one embodiment.

The disclosed wheelchair system and accessory system for a wheelchair may improve mobility of a wheelchair in some environments, such as on uneven or soft surfaces typically found outdoors. The accessory system may be added or removed from most commercially available wheelchairs, including rigid and collapsible frame wheelchairs. The accessory system, when attached to the wheelchair and engaged by the user, removes the original front wheels of the wheelchair from contact with the ground in favor of a larger accessory wheel and/or longer wheelbase. In some embodiments, the accessory wheel can rotate relative to the accessory frame about a vertical axis to enable the wheelchair to turn. The accessory further includes an engagement member that engages or disengages a rigid connection or load bearing connection between the accessory wheel and the accessory frame to raise or lower the original front wheels of the wheelchair relative to the ground. The vertical axis enabled by the engagement system overcomes disadvantages of other accessories which instead rely on a non-vertical axis of rotation when the original smaller front wheels of the wheelchair are raised relative to the ground. A user may add or remove the accessory system to or from the wheelchair, and may engage or disengage the accessory system while seated in the wheelchair.

Referring to FIGS. 1-7, an accessory system 140 for a wheelchair 100 may include an accessory frame 142, wheel assembly 146, and engagement system 148. Accessory frame 142 may have one or more interface elements 144 to mount to wheelchair frame 110. Wheel assembly 146 may be rotatably coupled to the accessory frame by a fastener 180 depicted, for example, in FIGS. 4-7. Engagement system 148 may further couple accessory frame 142 to wheel assembly 146, for example, via a capture member (e.g., channel guide member 170) and a captured element (e.g., translating member 176). The capture member may define a capturing region and the captured element may be adapted to fit within the capturing region of the capture member. FIGS. 8, 9, and 10 depict further examples of a capture member and a captured element that may be used as an engagement system.

Channel guide member 170 may define a channel 172 having a notched region 174. Channel guide member 170 may be rotatably coupled to one of accessory frame 142 or wheel assembly 146 by a fastener. Translating member 176 may be retained within channel 172 of channel guide member 170. Translating member 176 may include, for example, a pin configured to slide within channel 172 of channel guide member 170. Translating member 176 may be fixed to another one of accessory frame 142 or wheel assembly 146. As one example, channel guide member 170 may be rotatably coupled to wheel assembly 146 by fastener 178, and translating member 176 may be fixed to accessory frame 142. As another example, a channel guide member may be rotatably coupled to accessory frame by a fastener, and a translating member may be fixed to a wheel assembly. An axis of rotation about fastener 180 may be parallel to an axis of rotation about fastener 178. Fasteners 178 and 180 may each include, for example, a pin that completes or otherwise forms a hinge between one or more of accessory frame 142, channel guide member 170, and wheel assembly 146.

Figure 2:
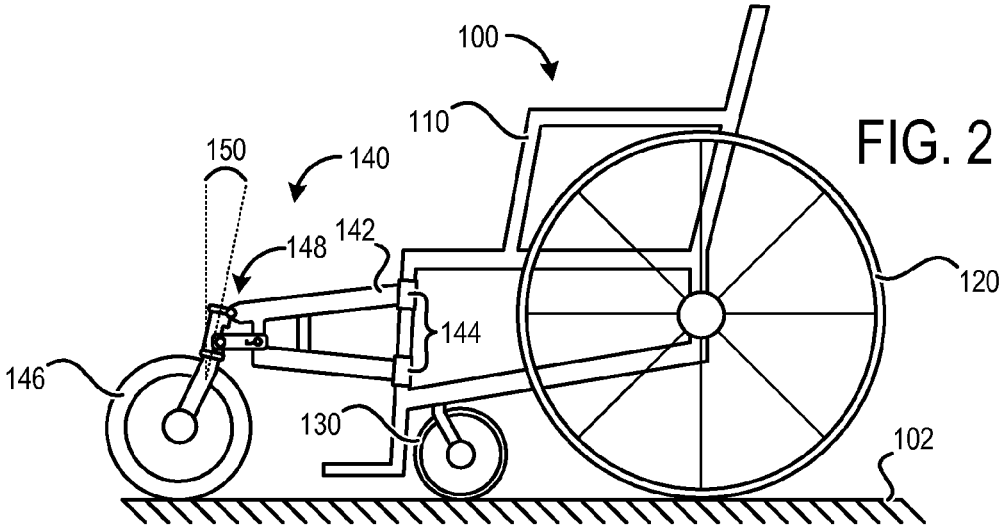
FIG. 2 is a schematic diagram depicting the example wheelchair of FIG. 1 further including an example accessory system in a disengaged state according to one embodiment.
Figure 3:
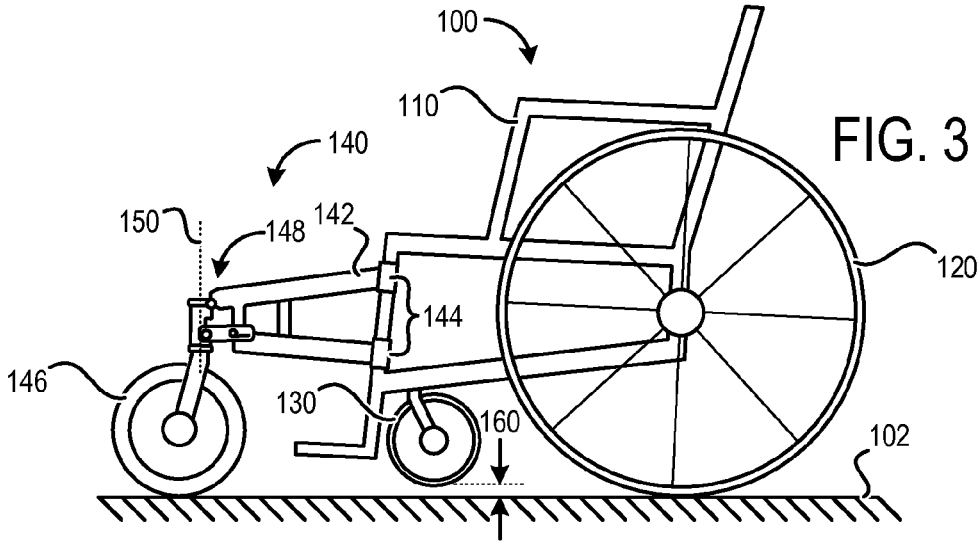
FIG. 3 is a schematic diagram depicting the example wheelchair including the example accessory system of FIG. 2 in an engaged state according to one embodiment.
Figure 4:
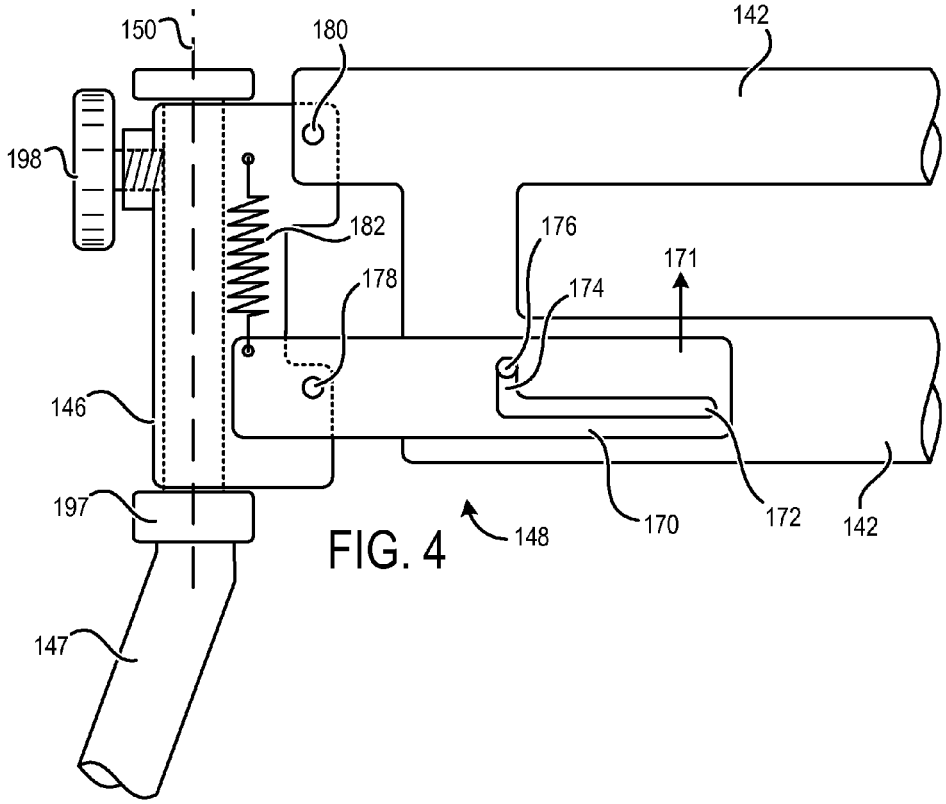
FIG. 4 is a schematic diagram depicting an example engagement system in an engaged state according to one embodiment.
Figure 6:
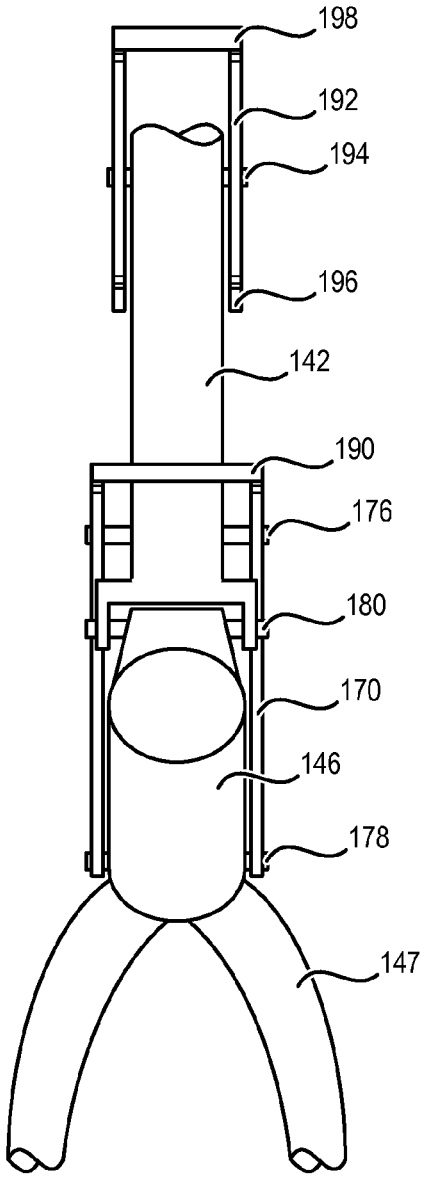
FIG. 6 is a schematic diagram depicting another view of the example engagement system of FIG. 4 in the disengaged state according to one embodiment.
Figure 7:
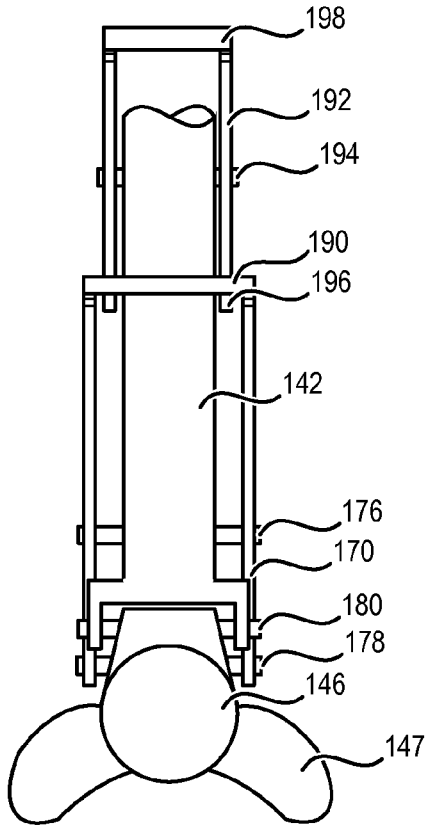
FIG. 7 is a schematic diagram depicting another view of the example engagement system of FIG. 4 in the engaged state according to one embodiment.

Translating member 176 if located within notched region 174 of channel 172 may provide a load bearing connection by engagement system 148 between wheel assembly 146 and accessory frame 142 as depicted, for example, by FIGS. 3, 4, and 7. Translating member 176 if located within channel 172 outside of notched region 174 may provide a non-load bearing connection by engagement system 148 between wheel assembly 146 and accessory frame 142 as depicted, for example, by FIGS. 2, 5, and 6.

Accessory system 140 may further include a control member 192, an example of which is depicted in FIGS. 6 and 7. Control member 192 may be configured to release translating member 176 from notched region 174 of channel guide member 170 upon activation of control member 192 by a user. As one example, control member 192 may include a lever that urges channel guide member 170 to release translating member 176 from notched region 174. The lever of control member 192 may be rotatably coupled to accessory frame 142 by a fastener 194. For example, as depicting by FIGS. 6 and 7, a user may disengage engagement system 148 by applying force to end 198 of control member 192 to cause an opposite end 196 to urge an end 190 of channel guide member, thereby releasing translating member 176 from notched region 174.

Wheel assembly 146 may include at least one wheel having a diameter selected such that the load bearing connection provided by engagement system 148 causes wheelchair 100 to be at least partially supported by wheel assembly 146 with front wheels 130 of wheelchair 100 raised relative to the ground 102 as depicted, for example, in FIG. 3 at 160. As depicted in FIG. 2, the non-load bearing connection by engagement system 148 causes wheelchair 100 to be at least partially supported by front wheels 130 with the front wheels contacting the ground 102. Hence, when engagement system 148 provides a load bearing connection, the wheelbase of the wheelchair system may be increased. Wheel assembly 146 may include one, two, or more wheels. As depicted in FIGS. 2 and 3, wheel assembly 146 may include at least one wheel having a larger diameter than front wheel 130 of wheelchair 100. However, one or more wheels of wheel assembly 146 may alternatively be the same diameter or of a smaller diameter than front wheel 130.

Figure 5:
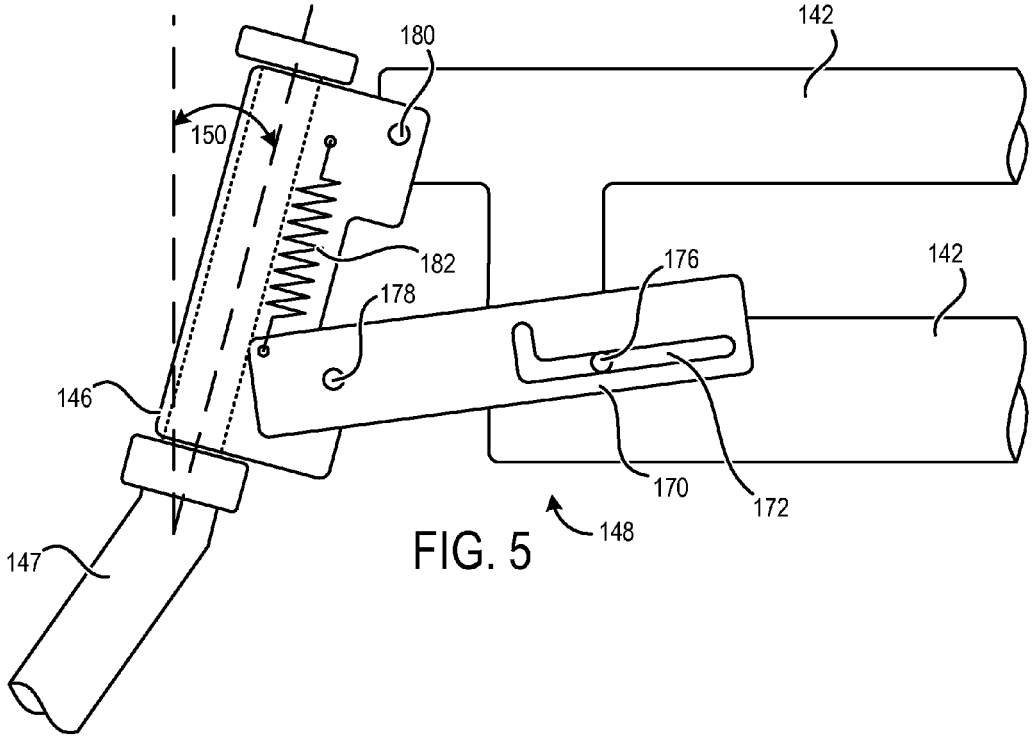
FIG. 5 is a schematic diagram depicting the example engagement system of FIG. 4 in a disengaged state according to one embodiment.

Fork portion 147 of wheel assembly 146 may rotate relative to head portion about an axis of rotation 150. Axis of rotation 150 may be inclined by a greater amount relative to a vertical/gravitational axis if translating member 176 is located outside of notched region 174 than if the translating member is located within the notched region. FIGS. 4 and 5 depict an example of how the axis of rotation of fork portion 147 may change as the position of translating member 176 changes. Axis of rotation 150 may be parallel to or substantially parallel to the vertical/gravitational axis if translating member 176 is located within notched region 174.

Accessory system 140 may include an elastic member 182 configured to urge translating member 176 toward or into notched region 174. Elastic member 182 may include a tension spring having a first end coupled to wheel assembly 146 and a second end coupled to channel guide member 170 as depicted, for example, in FIGS. 4 and 5. Other suitable types of elastic members may be utilized, including a compression spring, elastic band, flat spring, coil spring, etc.

Interface elements 144 of accessory system 140 may include one or more clamps for receiving respective frame members of wheelchair frame 110. Other suitable types of interface elements may be used to couple or otherwise attach accessory frame 142 to wheelchair frame 110. Accessory frame 140 may include a plurality of frame members forming a rigid frame. The plurality of frame members may be coupled to each other by one or more adjustment members enabling a size and/or shape of the accessory frame to be adjusted to accommodate wheelchairs of different sizes. Adjustment members may be located at any suitable location of the frame to provide suitable adjustment points.

In some embodiments, the previously described accessory system 140 may be integrated with wheelchair 100 as a wheelchair system. For example, the wheelchair frame and the accessory frame may be formed from one or more common frame members. The wheelchair system may include a wheelchair frame (i.e., integrated frames 110 and 140), a rear set of wheels (e.g., wheels 120) coupled to the wheelchair frame, an intermediate set of wheels (e.g., previously described as front wheels 130) coupled to the wheelchair frame, wheel assembly 146 rotatably coupled to the wheelchair frame by a fastener 180, and engagement system 148 further coupling wheelchair frame to wheel assembly 146. In this particular embodiment, channel guide member 170 of engagement system 148 may be rotatably coupled to one of the wheelchair frame or wheel assembly 146 by a fastener such as faster 178. Translating member 176 may be fixed to another one of the wheelchair frame or wheel assembly, such as frame 142.

FIG. 4 depicts an example where the accessory system may include a locking element 198 that may be engaged by a user to inhibit rotation of one or more wheels of the wheel assembly about the rotational axis (e.g., axis 150) that corresponds to a steering axis of the one or more wheels. For example, locking element 198 may be threaded so that a user may turn locking element 198 until a force is applied to or resists the rotation of a rotational element within the head of the wheel assembly 146. Alternatively, locking element 198 may include a pin that may be aligned with and inserted into a corresponding opening defined in the rotational element within the head of the wheel assembly to inhibit rotation of the wheel about axis 150. The pin may be spring loaded to retain the pin within the opening, for example.

FIG. 4 further depicts how one or more shim elements 197 may be utilized to vary or adjust the height between the head of the wheel assembly and the ground surface upon which the wheel is supported. By varying this height through the addition or removal of shim elements, the wheelchair system may accommodate accessory wheels of different diameters and/or an amount of clearance between the original front wheel of the wheelchair and the ground surface when set to the engaged state may be adjusted to accommodate different terrains. Alternatively or additionally, forks 147 of wheel assembly 146 may have a plurality of wheel attachment points located at different heights along the length of the forks to enable a user to utilize different accessory wheels and/or vary a clearance provided by the accessory system when set to an engaged state.

FIG. 8 depicts another example engagement system 800 that includes a capture member 810 defining a capturing region 812. Captured element 814 may be adapted to fit within capturing region 812. As previously discussed, if a captured element such as captured element 814 is within a capturing region such as capturing region 812, the engagement system may provide a load bearing connection. Furthermore, as previously discussed, the axis of rotation (steering axis) of the wheel assembly may be inclined by a greater amount relative to a vertical/gravitational axis if the captured element is located outside of the capturing region than if the captured element is located within the capturing region. For example, the axis of rotation may substantially parallel to the vertical/gravitational axis if the captured element is located within the capturing region and the engagement system is providing a load bearing connection.

FIGS. 9 and 10 depict yet another example engagement system 900 that includes capture members 910 and 912 defining a capturing region 914. Captured element 916 may be adapted to fit within capturing region 914. In this particular example, captured element 916 takes the form of a head portion of the wheel assembly (e.g., previously described wheel assembly 146). Furthermore, distal ends 922/924 of capture members 910 and 912 may be utilized by a user to release captured element 916 from capturing region 914. For example, capture members 910 and 912 may be urged inward by an elastic member (e.g., torsional spring) to retain captured element 916, but may also enable rotation about respective fasteners 918 and 920 to permit the captured element 916 to be released from capturing region 914 depicted in FIG. 9 to a position depicted, for example, by FIG. 10.

As previously discussed, if a captured element such as captured element 916 is within a capturing region such as capturing region 914, the engagement system may provide a load bearing connection. Furthermore, as previously discussed, the axis of rotation (steering axis) of the wheel assembly may be inclined by a greater amount relative to a vertical/gravitational axis if the captured element is located outside of the capturing region than if the captured element is located within the capturing region. For example, the axis of rotation may substantially parallel to the vertical/gravitational axis if the captured element is located within the capturing region and the engagement system is providing a load bearing connection.

Figure 11:
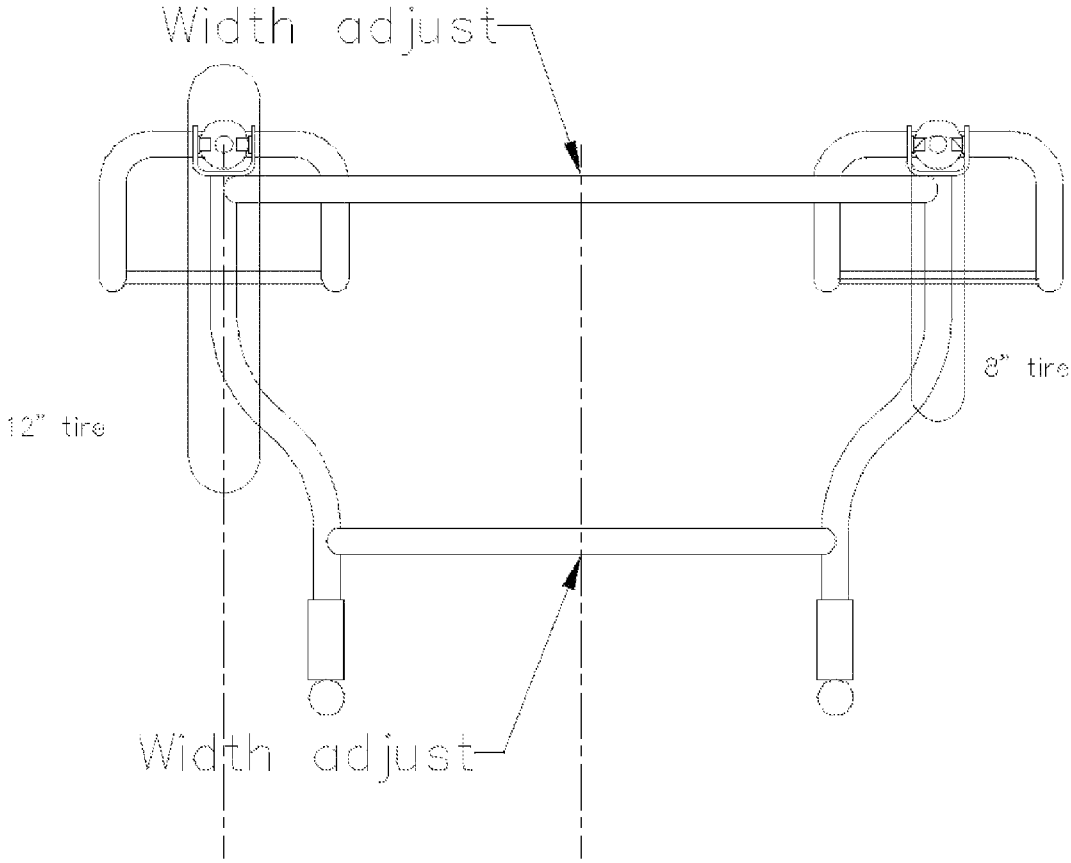
FIG. 11 is a schematic diagram depicting another example wheelchair system according to one embodiment.

FIG. 11 depicts how an accessory frame 1100 may include two wheel assemblies each having at least one respective wheel. FIG. 11 further depicts how the two wheels may have different diameters (e.g., an 8-inch tire and a 12-inch tire) in some embodiments. However, it will be understood that the two wheels may have the same diameter in other embodiments. FIG. 11 further depicts example adjustment points of the accessory frame where the shape and/or size of the frame may be adjusted to accommodate a variety of different wheelchairs.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims

The invention claimed is:

1. An accessory system for a wheelchair, comprising:

an accessory frame having one or more interface elements to mount to a wheelchair frame;

a wheel assembly rotatably coupled to the accessory frame by a first fastener;

an engagement system further coupling the accessory frame to the wheel assembly, the engagement system including:

a capture member defining a capturing region, the capture member rotatably coupled to one of the accessory frame or wheel assembly by a second fastener, and a captured element fixed to another one of the accessory frame or wheel assembly, the capture element adapted to fit within the capturing region of the capture member;

a control element configured to release the captured element from the capturing region of the capture member upon activation of the control element by a user; and wherein an axis of rotation of a fork portion of the wheel assembly relative to a head portion of the wheel assembly is inclined relative to a vertical/gravitational axis if the captured element is located outside of the capturing region and is substantially aligned with the vertical/gravitational axis if the captured element is located within the capturing region.

2. The accessory system of claim 1, wherein the channel guide member is rotatably coupled to the wheel assembly by the second fastener; and wherein the captured element is fixed to the accessory frame.

3. The accessory system of claim 1, wherein the channel guide member is rotatably coupled to the accessory frame by the second fastener; and wherein the captured element is fixed to the wheel assembly.

4. The accessory system of claim 1, wherein an axis of rotation about the first fastener is parallel to an axis of rotation about the second fastener.

5. The accessory system of claim 1, further comprising:

a locking element to inhibit rotation of one or more wheels of the wheel assembly about the axis of rotation of the fork portion relative to the head portion.

6. The accessory system of claim 1, wherein the control element takes form of a control member that includes a lever that urges the capture member to release the captured element.

7. The accessory system of claim 6, wherein the lever of the control member is rotatably coupled to the accessory frame by a third fastener

8. The accessory system of claim 1, wherein the captured element if captured by the capturing region of capture member provides a load bearing connection by the engagement system between the wheel assembly and the accessory frame.

9. The accessory system of claim 8, wherein the captured element, if not captured by the capturing region of the capture member, provides a non-load bearing connection by the engagement system between the wheel assembly and the accessory frame.

10. The accessory of claim 9, wherein the wheel assembly includes a wheel having a diameter such that:

the load bearing connection by the engagement system enables the wheelchair to be at least partially supported by the wheel assembly with the front wheels of the wheelchair raised relative to a ground surface.

11. The accessory system of claim 1, further comprising:

an elastic member configured to urge the captured element toward or into the capturing region.

12. The accessory system of claim 11, wherein the elastic member includes a tension spring having a first end coupled to the wheel assembly and a second end coupled to the capture member.

13. The accessory system of claim 1, wherein the wheel assembly includes one or more wheels; and wherein the wheel assembly includes at least one wheel having a larger diameter than a front wheel of the wheelchair.

14. The accessory system of claim 1, wherein the wheel assembly includes two wheels of the same diameter.

15. The accessory system of claim 1, wherein the wheel assembly includes two wheels having different diameters.

16. The accessory system of claim 15, wherein the two wheels of the wheel assembly each have diameters that are larger than a front wheel of the wheelchair.

17. The accessory system of claim 1, wherein the interface elements include one or more clamps for receiving respective frame members of the wheelchair frame; and wherein the accessory frame includes a plurality of frame members forming a rigid frame, the plurality of frame members coupled to each other by one or more adjustment members enabling a size of the accessory frame to be adjusted to accommodate wheelchairs of different sizes.

18. A wheelchair system, comprising:

a wheelchair frame;

a rear set of wheels coupled to the wheelchair frame;

an intermediate set of wheels coupled to the wheelchair frame;

a wheel assembly rotatably coupled, about a first axis of rotation, to the wheelchair frame by a first fastener permitting a second axis of rotation of a fork portion of the wheel assembly to be inclined relative to a vertical/gravitational axis in a first orientation in which the intermediate set of wheels contact a ground surface and the second axis of rotation to be substantially aligned with the vertical/gravitational axis in a second orientation in which the intermediate set of wheels are raised relative to the ground surface, the wheel assembly further including at least one front wheel; and an engagement system further coupling the wheelchair frame to the wheel assembly, the engagement system including:

a channel guide member defining a channel having a notched region, the channel guide member rotatably coupled to one of the wheelchair frame or wheel assembly by a second fastener; and a translating member retained within the channel of the channel guide member, the translating member fixed to another one of the wheelchair frame or wheel assembly, the second orientation of the wheel assembly corresponding to the translating member being retained by the notched region within the channel guide member and the first orientation of the wheel assembly corresponding to the translating member being retained within the channel guide member outside of the notched region.

19. An accessory system for a wheelchair, comprising:

an accessory frame having one or more interface elements to mount to a wheelchair frame;

a wheel assembly rotatably coupled to the accessory frame by a first fastener, the wheel assembly including a head portion, a fork portion, and one or more wheels;

an engagement system further coupling the accessory frame to the wheel assembly, the engagement system providing a load bearing connection between the wheel assembly and the accessory frame in an engaged state in which an axis of rotation of the fork portion relative to the head portion is substantially aligned with a vertical/gravitational axis, and the engagement system providing a non-load bearing connection between the wheel assembly and the accessory frame in a disengaged state in which the axis of rotation of the fork portion relative to the head portion is angled relative to the vertical/gravitational axis; and a control element configured to disengage the engagement system upon activation by a user to transition the engagement system from an engaged state to a disengaged state.

* * * * *